United States Patent [19]

Ishiwata et al.

[11] 3,956,790

[45] May 18, 1976

[54] METHOD OF APPARATUS FOR REMOVING DUST FROM THE SURFACE OF A MOVING WEB

[75] Inventors: Mamoru Ishiwata; Katzutaka Yoshida; Hiroshi Nozawa, all of Minami-ashigara, Japan

[73] Assignee: Fuji Photo Film Co., Ltd., Minami-ashigara, Japan

[22] Filed: July 23, 1974

[21] Appl. No.: 491,009

Related U.S. Application Data

[60] Division of Ser. No. 326,223, Jan. 24, 1973, abandoned, which is a continuation-in-part of Ser. No. 90,239, Nov. 17, 1970, abandoned.

[30] Foreign Application Priority Data

Nov. 18, 1969 Japan ..... 44-92399

[52] U.S. Cl. ..... 15/302; 15/306 A; 15/345; 134/64 P

[51] Int. Cl.[2] ..... A47L 5/38

[58] Field of Search ..... 15/302, 306 A, 306 R, 15/345, 346; 134/64, 122; 118/410

[56] References Cited

UNITED STATES PATENTS

| | | | |
|---|---|---|---|
| 2,245,109 | 6/1941 | Lapeyrouse | 15/306 A X |
| 2,965,314 | 12/1960 | Salomon | 134/122 X |
| 3,495,932 | 2/1970 | Tuma | 15/345 X |
| 3,521,602 | 7/1970 | Coghill | 118/410 |
| 3,841,910 | 10/1974 | Baker | 15/345 X |

*Primary Examiner*—Peter Feldman
*Assistant Examiner*—C. K. Moore
*Attorney, Agent, or Firm*—Sughrue, Rothwell, Mion, Zinn & Macpeak

[57] ABSTRACT

Dust is removed from a running web by a counterflow liquid bath and downstream application of one or more high velocity air jets to a localized convex curvature of the web, said application of high velocity air jets being accompanied by application of vacuum pressure to remove the mist created by the air jets.

5 Claims, 2 Drawing Figures

INVENTORS
MAMORU ISHIWATA
KAZUTAKA YOSHIDA
HIROSHI NOZAWA

BY Sughrue, Rothwell, Mion, Zinn & Macpeak
ATTORNEYS

METHOD OF APPARATUS FOR REMOVING DUST FROM THE SURFACE OF A MOVING WEB

CROSS-REFERENCE TO A RELATED APPLICATION

This application is a divisional of application Ser. No. 326,223 filed Jan. 24, 1973 and abandoned subsequent to the filing of this application. That application was in turn a continuation-in-part of application serial number 90,239, filed November 17, 1970, and abandoned subsequent to the filing of application Ser. No. 326,223.

BACKGROUND OF THE INVENTION

1 Field of the Invention:

This invention relates to a method of removing adhering particles from the surface of the running web and an apparatus for carrying out the method and, more specifically, to a method of and apparatus for removing dust from a photosensitive material running web prior to applying the photosensitive emulsion thereto.

2 Description of the Prior Art:

In accordance with the usual techniques for applying emulsion on a moving plastic film, paper and the like, it has been known to employ a doctor blade method, bead method and the like. In the doctor blade method, the dust adhering to the back surface of the web causes white spots on the photosensitive films. In the bead method, the dust adhering on the surface of the web causes unevenness in thickness and scratches or streaks formed on the surface of the applied emulsion which are serious imperfections in the applied emulsion layer. The present invention prevents the above described imperfections in applying emulsion on the web by removing the dust from the front and back surfaces of the running web.

Heretofore, it has been proposed to remove the dust from the running web by utilizing air blow, air suction, brushing, direct removal with a knife or a doctor blade, attraction of static electricity, or a combination of the above, and the like. However, these methods of removing dust involve certain disadvantages, such as low removal effects, adhering flocks from the brush, the generation of scratches, and the like. Accordingly, there has been no adequate method of removing the dust adhering to the web which sufficiently removes the same prior to the final production of the photosensitive film without major disadvantages.

It has also been known in the art to wash the web in water in order to remove the dust adhering to the web. However, this method is disadvantageous, first in that the undercoated layer may be humidified and affected chemically by the water unless the water is quickly and thoroughly dried from the web and, second, in that it causes the generation of hills and valleys in the emulsion layer unless all the water has been dried from the web before the emulsion layer is applied. Another disadvantage inherent in the use of the method just described is that such equipment occupies a large area of a plant and is large and complicated.

SUMMARY OF THE INVENTION

In the light of foregoing observations and description, the present invention provides a method of and an apparatus for removing dust from the surface of the running web which is highly effective in removal of dust and which equipment does not occupy a large area.

Another object of the present invention is to provide a method of and an apparatus for removing dust from the surface of a running web which requires no special equipment with no fear of scratching the surface of the web and no fear of humidifying the undercoated layer of the web.

In the method and apparatus of the present invention, the surface of the web is washed with a fountain-type washer supplying washing liquid through a flow discharge slot, the surface of the web is given a localized curvature, and the curved portion of the washed surface of the web bearing the washing liquid is air blown and sucked with a blower and a sucking means respectively, whereby the liquid on the web is removed.

DETAILED DESCRIPTION OF A PREFERRED EMBODIMENT

Figure 1:
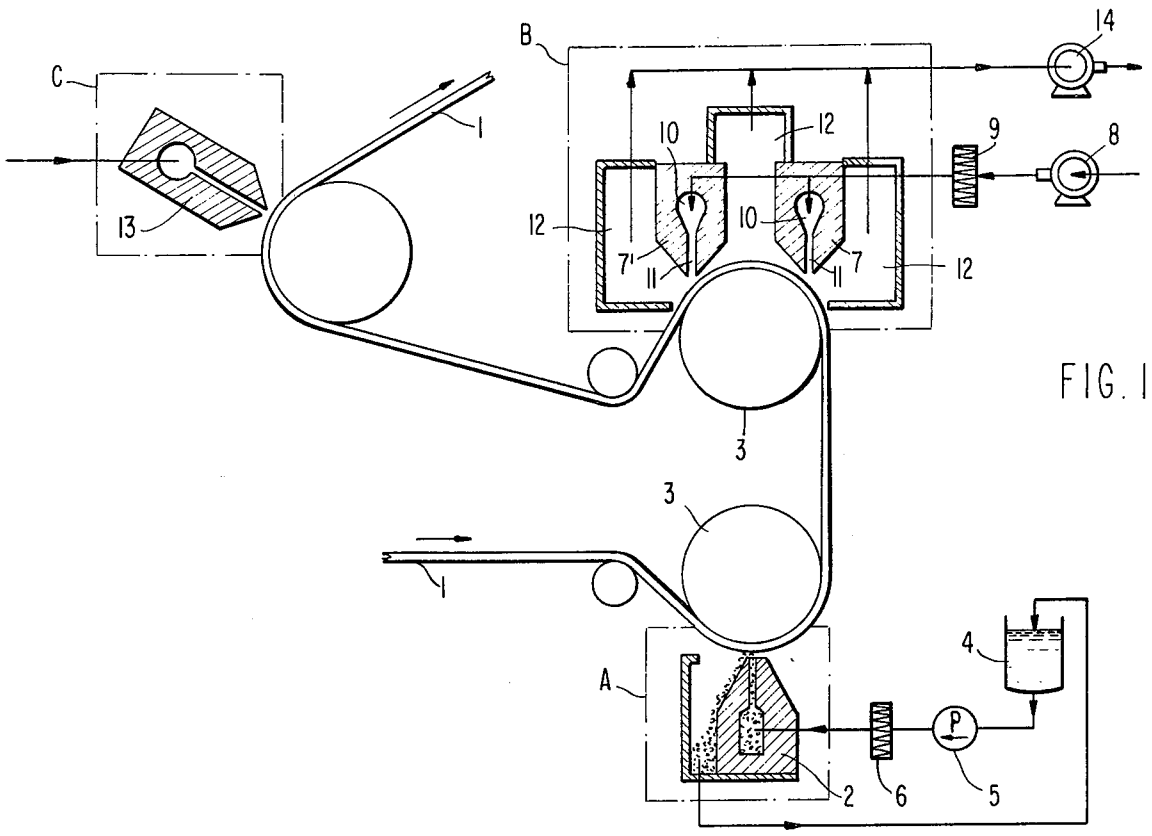
FIG. 1 is a partially schematic, elevational, sectional view of an embodiment of the present invention.

Now referring to FIG. 1, the web 1, on which emulsion is to be applied, is fed along a path defined by a plurality of rollers. First, the web 1 passes a washing section A. At the washing section A, the web 1 is fed about a supporting roller 3 disposed above washer 2, more clearly shown in FIG. 2. To the washer 2 is supplied washing liquid from a reservoir 4 via pump 5 and filter 6. The washing liquid overflows from the washer 2 and is returned to the reservoir 4. Thus, the liquid continuously circulates through the reserver 4, pump 5, filter 6 and washer 2.

The web 1 is then wrapped around a second supporting roller 3 to give its surface a localized curvature as it passes by a liquid removing section B. At the liquid removing section B, compressed air is blown against the surface of the moving web 1 by a pair of identical liquid removers 7 and 7′. The compressed air is supplied by a high pressure blower 8 through an air filter 9 to high pressure chambers 10. The air introduced into the chambers 10 is then discharged through the slits 11 against the surface of the moving web 1 at an angle thereto of between 0° and 30°, in the case of liquid remover 7, and if between 150° and 180°, in the case of liquid remover 7′. The discharge of the compressed air against the wet web creates a mist of the washing liquid, and this mist, together with the blown air, is exhausted via a decompression chamber 12 occupying both sides of liquid removers 7 and 7′. The pump 14 is provided to subject the decompression chamber 12 to a vacuum pressure.

The web 1, from which the washing liquid has been removed by the high speed blowing air, is then fed through an emulsion coating section C, where an emulsion liquid or the like is applied on the running web 1 by a coating device 13. Then, the web 1 passes through setting and drying zones (not shown).

Figure 2:
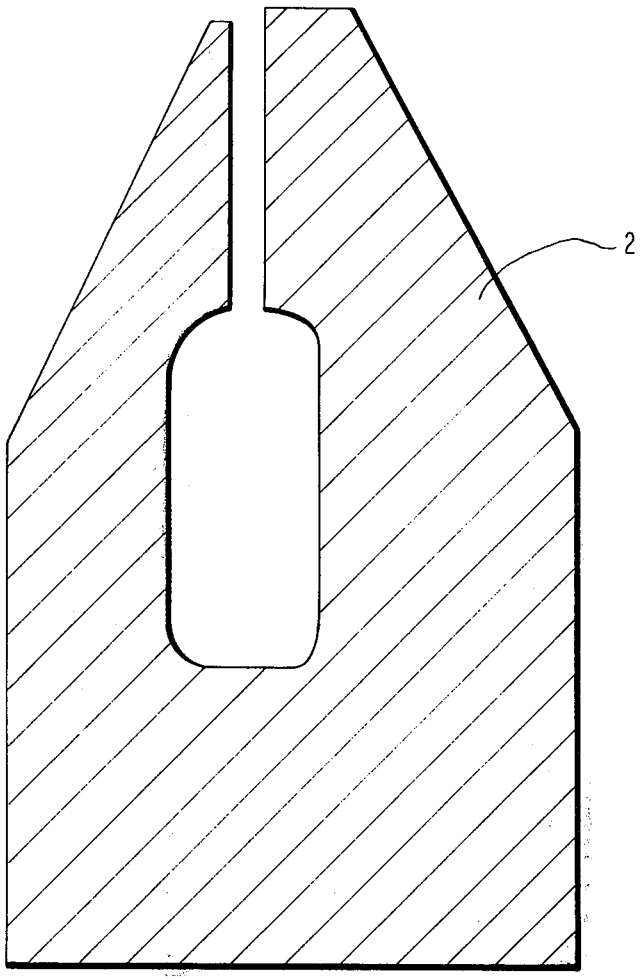
FIG. 2 is an elevational, sectional view in enlarged size of one element of the embodiment shown in FIG. 1.

The washer 2, depicted in enlarged fashion in FIG. 2, is of the fountain type and is so constructed that the liquid overflowing at the lips of the slot flows down the side of the same in the direction opposite to the running direction of the web. In order to make the liquid flow in the above described direction, the length in the running direction of the lip on the downstream side of the slot is made longer than the lip on the upstream side, and the space between the web and the lip is made smaller on the downstream side. The difference in the distance from the web to the lip may, for instance, be between 0.25 and 0.5mm and the length of the lip on the upstream and downstream sides of the slot may be 0.8–1.0mm and 2.5 mm, respectively. Based on the above stated construction of the lips of the slot of the washer 2, the washing liquid is subject to a larger resistance on the downstream side of the slot. Accordingly, the overflowing liquid flows in the direction opposite to the running direction of the web. Thus, dust stuck on the web is washed away by the backward flow of the washing liquid.

Generally, where dust is stuck on the web, the adhering energy $E_A$ is regarded as the sum of mechanical, electrical, and chemical adhering energy, which is represented as a formula as follows:

$$E_A = E_{AM} + E_{AE} + E_{AC} \quad (1)$$

where $E_{AM}$ is mechanical adhering energy, $E_{AE}$ is electrical adhering energy and $E_{AC}$ is chemical adhering energy.

On the other hand, the energy required to remove the dust adhering to the web, $E_D$, is similarly regarded as $$E_D = E_{DM} + E_{DE} + E_{DC} \quad (2)$$

where $E_{DM}$ is mechanical removing energy, $E_{DE}$ is electrical removing energy, and $E_{DC}$ is chemical removing energy.

However, the conditions for satisfactory removal of the dust adhering on the web is not simply that the formula $$E_D > E_A \quad (3)$$

be satisfied. Rather, it is that each of the formulae $$E_{DM} > E_{AM} \quad (4)$$

$$E_{DE} > E_{AE} \quad (5)$$

$$E_{DC} > E_{AC} \quad (6)$$

be independently satisfied. This means, for example, that the cleaning method utilizing blowing or sucking of air alone does not satisfy the above formule (5) and (6), but satisfies only the formulae (3) and (4). In such a case, the dust can not be removed electrically and chemically.

At the washing section of the wet type, in accordance with the present invention, the formulae (5) and (6) are satisfied by electrically and chemically treating the washing liquid and the formula (4) is satisfied by making the liquid flow backwards at the slot of the washer 2 Combining these two cleaning methods, the dust on the web can be sufficiently removed.

The washing liquid may be pure water, trichloroethylene, other organic solvents, soapsuds, inorganic water, or the like. From the view point of the influence of the washing liquid on the web, the washing liquid is desired to have property of not degrading the quality of the web and not affecting the subsequent process. On the basis of the above view point, the washing liquid is preferred to be water containing a small amount of anion agent.

In the present invention, the washing liquid in contact with the surface of the running web 1 should be kept pure by being filtered through a filter 6 when introduced into the washer from the pump 5. Thus, the washing effect can be kept constant.

The web 1 washed at the washing portion A bears about 100 g/m² of washing liquid when fed at the speed of around 30 m/min. This washing liquid remains on the surface of the web 1 and is removed by the liquid remover 7 at the liquid removing section B. At the liquid removing section B, high pressurized air is ejected through the slit 11. The pressurized air ejected from the high pressure chamber 10 at an ejecting speed of 250–350 m/sec, blows off the washing liquid adhering on the web 1. The mist made by this blowing off process is sucked through the decompression chamber 12 together with the blown air. The high pressurized air ejected from the pressure chamber 10 is not required to be at high temperature. If the liquid remover were not provided in the system or if the liquid remover were not operated in sufficiently effective condition, a cloud-like unevenness would occur in the coating process. By the provision of this liquid remover and an appropriate operation of the same, almost all the washing liquid remaining on the surface of the web is removed and high quality photosensitive material can be obtained. The construction of the liquid remover 7 may be of the type which has a single high pressure chamber and a single decompression chamber, but is preferred to be of the type which has two high pressure chambers and three decompression chambers from the view point of a favorable removing effect.

The advantages obtained in accordance with the present invention are as follows:

1. Since the dust adhering to the web electrically and chemically can be completely removed, it is possible to obtain a photosensitive material of high quality having no white spots.

2. Since there is no need to stop the applying operation of the liquid applying system to clean the liquid applying system and washing system when the scratches or unevenness on the web begins to appear, the efficiency of the system increases.

3. Since the imperfection of the surface of the web such as the scratches, white spots, and the like is prevented from occurring, the conditions for applying the liquid are made easier, and it becomes possible to obtain much improved uniformity in thickness of the applied layer on the web. In particular, due to the localized curvature of the web at the liquid removing station and the angle at which the air jets are applied, it is possible to virtually eliminate undesirable effects on the undercoated layer and the emulsion layer due to retention of the washing liquid on the web.

Now, the superior results obtainable with the present invention will be illustrated with some actual test data.

EXAMPLE 1

A multi-doctor blade type coating device was used to apply photosensitive emulsion layer for medical X-ray films and a protective layer successively on triacetylcellulose base at the speed of 50 m/min. As the washing liquid, water containing 0.01% of anion agent was used and supplied to the washing portion at the rate of 10 *l*/min per 1m of width of the web. The pressure within the high pressure chamber was 6000 mm $H_2O$ and the air was ejected through a slit of the liquid remover at a rate of 300m/sec. The negative pressure within the air suction reduction chamber was - 600mm $H_2O$. When the device of the invention was operated under the above conditions to remove the dust adhering to the web, the unevenness in applied thickness of the emulsion on the web due to the existence of the dust was completely removed. This result may be contrasted with an average of ten "hills and valleys" per 1000m roll obtainable with prior art devices. Furthermore, the web was not subject to any influence on transmissivity, friction coefficient, properties of adhesiveness, curl, color density, voltage charge and the like through the washing process.

EXAMPLE 2

A multi-slide type coating device was used to apply photosensitive emulsion layers for motion picture positive color film together with protective layer on a triacetylcellulose base at the rate of 40 m/min. A washing liquid of the same type as was used in the first example described above was used at the rate of 6 *l*/min per 1 m of width of the web. The pressure within the high pressure chamber was 5000 mm $H_2O$, and the air jet through the slit of the liquid remover was set at a rate of 270 m/sec. The negative gauge pressure within the reduction chamber was −500 mm $H_2O$. The dust on the web was thus removed. A longitudinal streak which had been seen once per 1 m width in a roll 800 m long, in the conventional system, was not seen on the web processed with the dust removing apparatus in accordance with the present invention. Again, web processed with the apparatus of the invention was not subject to any undesirable influence on the photosensitive material such as friction coefficient, transmittivity, curl, charge, and the like as a result of the washing process.

EXAMPLE 3

Cellulose powder was dispersed on a web at the rate of 5 g/m² by an electrostatic dust sprayer. The web was then treated in the three ways, (i), (ii), and (iii), as set forth in the table below. After the web had been coated with photosensitive materials, each portion of web was carefully inspected. The numbers of white spots caused by particles of the powder remaining on the web prior to the coating were as follows:

| | | |
|---|---|---|
| (i) Without any cleaning device | 50–100 | spots/m² |
| (ii) Cleaned by air jets only | 5–15 | spots/m² |
| (iii) Cleaned by the embodiment of the invention shown in Figure 1 | 0–1 | spots/m² |

This Example illustrates the efficacy of the present invention in removing dust particles from a web.

EXAMPLE 4

A web was passed by a washing section such as section A in FIG. 1 and subsequently passed through a liquid removing section such as section B in FIG. 1 and an emulsion coating section such as section C in FIG. 1. In the liquid removing section, however, the angle between the surface of the moving web and the air jet, the speed of the jet air, and the suction pressure were all subject to variation. Three experiments were conducted with this apparatus.

First, holding the speed of the projecting air above 250 m/sec and the gauge pressure under −400 mm $H_2O$, but allowing the angle of the air jets to vary, it was discovered that the magnitude of the hill and valley effect on the photographic film varied as follows after coating and drying the film:

| Angle between the Air Jet and the Web | Magnitude of the Hill and Valley Effect |
|---|---|
| (i) between 45° and 135° | large |
| (ii) between 30° and 45° and between 135° and 150° | small |
| (iii) between 0° and 30° and between 150° and 180° | no perceptible effect |

Second, with the angles between the downstream and upstream air jets and the web held between 0° and 30° and between 150° and 180°, respectively, and the vacuum pressure held beneath −400 mm $H_2O$, the speed of the jet air was then reduced to less than 250 m/sec. While no hill and valley effect was perceptible for air speeds in excess of 250 m/sec, a hill and valley effect became perceptible when the air speed was decreased to less than that figure.

Third, with the angles between the air jets and the web held between 0° and 30° and between 150° and 180°, respectively, and the air speed held above 250 m/sec, the vacuum pressure was decreased to above −400 mm $H_2O$. While no hill and valley effect was perceptible for vacuum pressure beneath −400 mm $H_2O$, a hill and valley effect became perceptible when the vacuum pressure was decreased to less than that figure.

This Example illustrates the efficacy of the present invention in removing washing liquid from a web.

It should be understood that the present invention is not limited to application to photosensitive material production, but may be applicable to the production of magnetic recording material and other similar webs which are preferred to be free from dust thereon.

What is claimed is:

1. Apparatus for removing dust from a moving web, said apparatus comprising:

a. a fountain washer having a discharge slot defined by two lips, the upstream lip being spaced further from the moving web during use of the apparatus than the downstream lip, whereby the overflowing liquid flows in the direction opposite to the running direction of the web during use of the apparatus, and b. a liquid removing means downstream of said fountain washer, said liquid removing means comprising:

i. means for giving the moving web a localized curvature;

ii. means for blowing compressed air against the outer surface of the curved moving web at an angle to the surface the absolute value of which is between 0° and 30°, thereby creating a mist of the washing liquid, and iii. means for exhausting the mist and the blown air from the vicinity of the moving web.

2. Apparatus as recited in claim 1 wherein said means for blowing delivers air to the moving web at a speed of not less than 250 meters per second and said means for exhausting water and air pressure of not higher than 400 mm $H_2O$.

3. Apparatus as recited in claim 1 and further comprising means for recirculating the washing liquid.

4. Apparatus as recited in claim 1 wherein said means for blowing comprise two air jets, one directed at the outer surface of the curved moving web at an angle of between 0° and 30° and the other directed at the outer surface of the curved web at an angle of between 150° and 180°.

5. Apparatus as recited in claim 4 wherein said air jets and said means for exhausting are all contained in a common chamber, part of the boundary of which is defined by the outer surface of the curved moving web.

* * * * *